US005255713A

United States Patent [19]

Scholle et al.

[11] Patent Number: 5,255,713

[45] Date of Patent: Oct. 26, 1993

[54] VALVE WITH INTEGRAL PLASTIC SPRING FOR POPPET

[75] Inventors: William J. Scholle; Chester Savage, both of Irvine, Calif.

[73] Assignee: Scholle Corporation, Irvine, Calif.

[21] Appl. No.: 819,268

[22] Filed: Jan. 10, 1992

[51] Int. Cl.[5] ..... F17D 1/08

[52] U.S. Cl. ..... 137/614.04; 137/535; 251/149.6

[58] Field of Search ..... 137/614.04, 903, 535, 137/540, 843, 630.22; 222/501, 522; 251/149.6

[56] References Cited

U.S. PATENT DOCUMENTS

| | | | |
|---|---|---|---|
| 2,984,393 | 5/1961 | Magnenat | 222/501 |
| 4,137,930 | 2/1979 | Scholle | 137/68 |
| 4,286,636 | 9/1981 | Credle | 251/149.6 X |
| 4,564,132 | 1/1986 | Lloyd-Davies | 222/522 |
| 5,072,756 | 12/1991 | Carr | 137/614.04 |

*Primary Examiner*—Martin P. Schwardron

*Assistant Examiner*—Kevin L. Lee

*Attorney, Agent, or Firm*—Richard F. Carr; Richard L. Gausewitz; Allan Rothenberg

[57] ABSTRACT

A valve is provided which includes a valve body having a passageway from an inlet end to an outlet end and a tapered annular valve seat intermediate the ends, a plastic poppet being provided with a disc portion and a tapered portion which can engage the valve seat, the tapered part being stepped to provide a deflectable outer edge portion, the poppet including three beams which extend toward the inlet end of the body and are bent outwardly to enter a groove in the valve body, thereby providing resilient means to bias the poppet to a closed position. The valve body includes a transverse wall adjacent the valve seat, the wall having openings for allowing flow through the passageway and also including an opening that receives a post projecting from the poppet toward the outlet end and beyond the wall for engagement by a mating connector to displace the poppet to its open position.

20 Claims, 2 Drawing Sheets

FIG. 2.
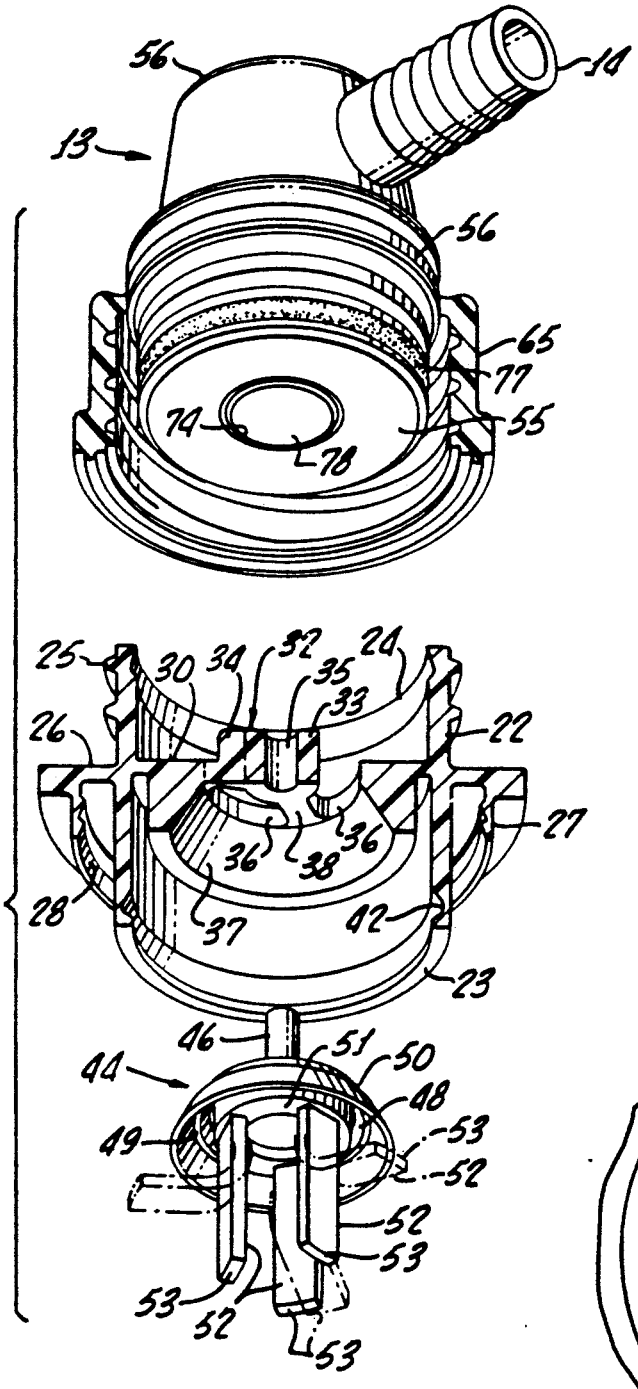
FIG. 1.
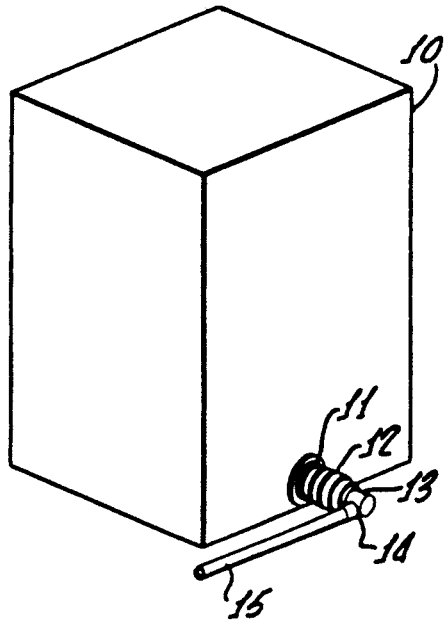
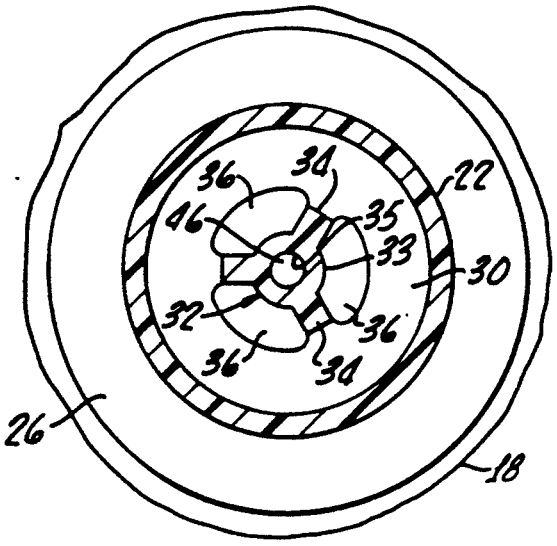
FIG. 5.

VALVE WITH INTEGRAL PLASTIC SPRING FOR POPPET

BACKGROUND OF THE INVENTION

Various liquids are marketed in bag-in-box containers connected through a suitable conduit to a dispenser at the point of use. The liquid may be, for example, syrup for soft drinks in restaurants or bars. Wine and other liquids may be dispensed in a similar manner, as may more viscous liquids such as certain condiments and salad dressings. It is desirable to have a normally closed valve at the container to assure that there is no flow of fluid until the container is connected to the line. Similarly, the line needs to be provided with a shut-off valve to avoid leakage when it is not connected to the container. Both valves should close automatically, rapidly and completely when the line connector is separated from the container.

Units for accomplishing such operation are disclosed in U.S. Pat. Nos. 4,564,132 and 5,072,756. There the valve attached to the container includes a body with a transverse wall provided with openings, and a bead around the openings. A diaphragm beneath the wall engages the bead preventing flow through these openings. There are openings through the diaphragm outside of where it engages the bead, but in the normal position where the diaphragm engages the bead there is no communication from the diaphragm openings to the openings in the wall.

When the line connector is coupled to the container valve, the diaphragm is displaced from its seat to open that valve. Also, the plunger of the line connector is forced away from its seat to an open position. Both valves close when the line connector is uncoupled.

The container valve must rely entirely on the resilient force exerted by the diaphragm to be moved to and held in the closed position. This limits the size of the openings through the diaphragm and hence the flow area of the valve. If the openings are made too large, the diaphragm will not reliably assume the closed position because the cross-sectional area of the diaphragm is insufficient to create an adequate closing force. Even with small openings, the force to close the valve is limited and less than that needed for controlling the flow of certain liquids. As a result, the diaphragm-type valve is limited in its applicability and cannot be used for various viscous fluids.

It has also been proposed to construct a plastic valve member with an integral spring, as in U.S. Pat. No. 4,286,636. However, the spring in that instance is either a bellows or a coil spring with a ring base at the outer end. Such springs are relatively difficult to mold so that tooling is expensive, which raises the cost of the parts produced. The ring at the base of the spring requires excess material. The coil spring produced tends to provide an offcenter force on the valve member which detracts from its ability to seal at the valve seat.

SUMMARY OF THE INVENTION

The present invention provides an improved valve unit overcoming the disadvantages of the prior art. In the present invention the number of parts is minimized, the cost of construction is reduced and there is full assurance of complete reliability of operation. Viscous liquids may be transmitted readily without sacrificing the force necessary to close the valve. A large flow area is provided through the valve. The entire unit may be made of plastic so that it is recyclable.

In this invention, a valve body includes a transverse wall in a passageway that extends from an inlet end to an outlet end of the body. A tapered valve seat is formed as part of the wall and the wall has openings through it downstream of the valve seat to allow flow through the passageway.

A plastic poppet includes a central disc part and a tapered flange for engaging the valve seat to close the valve. The flange is of stepped configuration so as to provide a deflectable outer portion of greater lateral dimension than the portion adjacent the disc to improve its ability to seal against the valve seat.

Projecting from the disc are three integral beams which are equally spaced and in their free positions are straight and perpendicular to the disc portion. These beams extend toward the inlet end. When the poppet is installed in the valve body, the beams are bent outwardly so that the outer ends of the beams are received in an annular groove in the inner wall of the valve body. This retains the outer ends of the beams. The beams so deflected act as leaf springs providing a resilient force biasing the poppet toward the closed position. A strong spring force can be obtained in this manner assuring that the poppet can be held tightly closed.

Projecting from the disc portion toward the outlet end of the valve body is a post which extends through a central opening in the transverse wall of the valve body. The end of the post is beyond a projecting collar that circumscribes the post. Therefore, when a line connector is brought into engagement with the valve body, the plunger within the line connector can engage the end of the post to push the poppet to its open position, while the end of the collar arrests the movement of the plunger so that it can be displaced from its seat as the line connector is fully mated with the valve body. When the line connector is disengaged from the valve body, the bent beams of the poppet move the poppet to the closed position to prevent flow through the passageway so that a fluid container to which the valve body is connected will retain its remaining contents.

The entire valve unit is made up of only two pieces, namely, the valve body and the poppet and both of these may be of plastic to permit recycling. Relatively large openings may be provided in the transverse wall of the valve body without sacrificing the spring force to bias the poppet toward the closed position. Therefore, even viscous liquids may be transmitted without difficulty. Despite the large openings through the valve the strong spring force provided by the resilient beams assures complete valve closure when the line connector is removed. The unit is easily produced without the necessity for complicated tooling. A minimum amount of material is necessary.

The three leaf springs provide a balanced force on the poppet so that the poppet will maintain alignment with the valve seat and the flange of the poppet can seal effectively.

BRIEF DESCRIPTION OF THE DRAWINGS

FIG. 1 is a perspective view of a container incorporating the valve unit of this invention;

FIG. 2 is an enlarged, exploded perspective view of the container valve, partially in section;

FIG. 5 is a transverse sectional view taken along line 5—5 of FIG. 3.

DETAILED DESCRIPTION OF THE INVENTION

Figure 3:
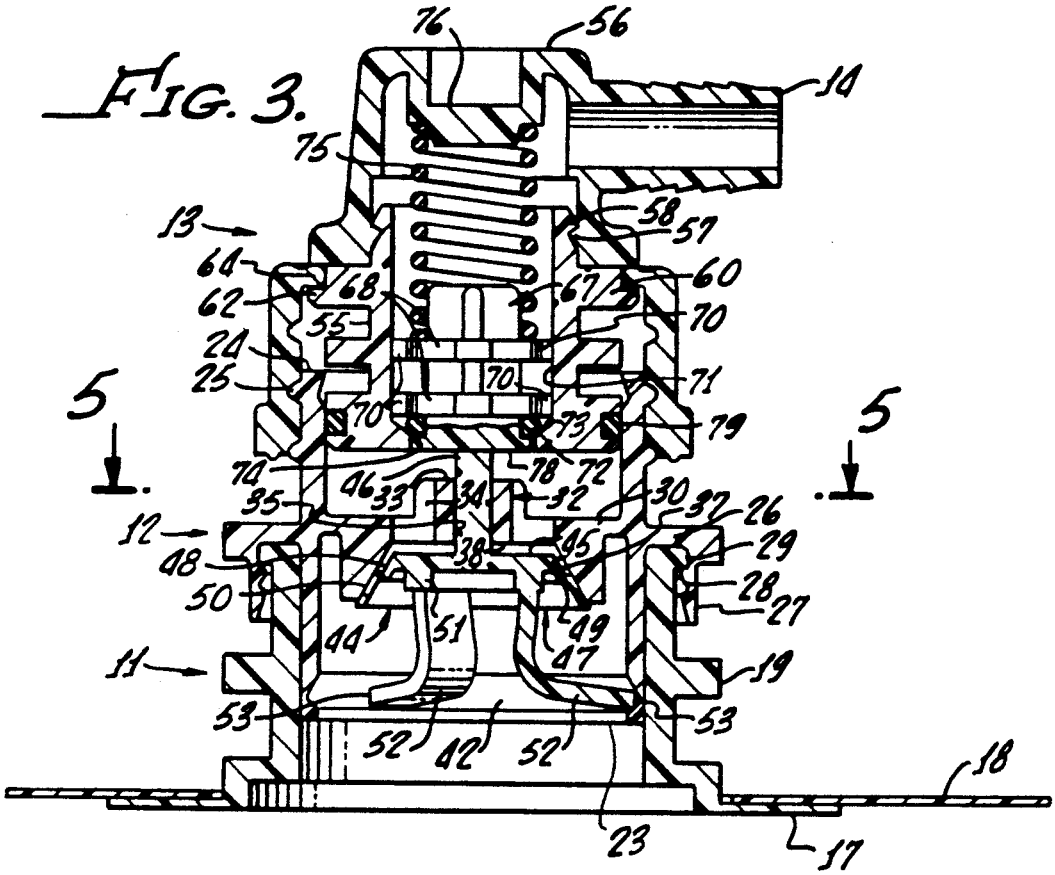
FIG. 3 is a longitudinal sectional view of the container valve associated with the line connector, shown at an intermediate position during the mating of the two valves, prior to the opening of the valves.

As shown in FIG. 1, the box 10 of a bag-in-box container is provided with an opening in its side through which extends a nozzle 11 connected to a bag within the box. The nozzle 1 1 discharges through a control valve 12 into a line connector 13, which may be of conventional design, and through an outlet 14 and a hose 15 can conduct the contents of the bag within the box 10 to the point of use.

Figure 4:
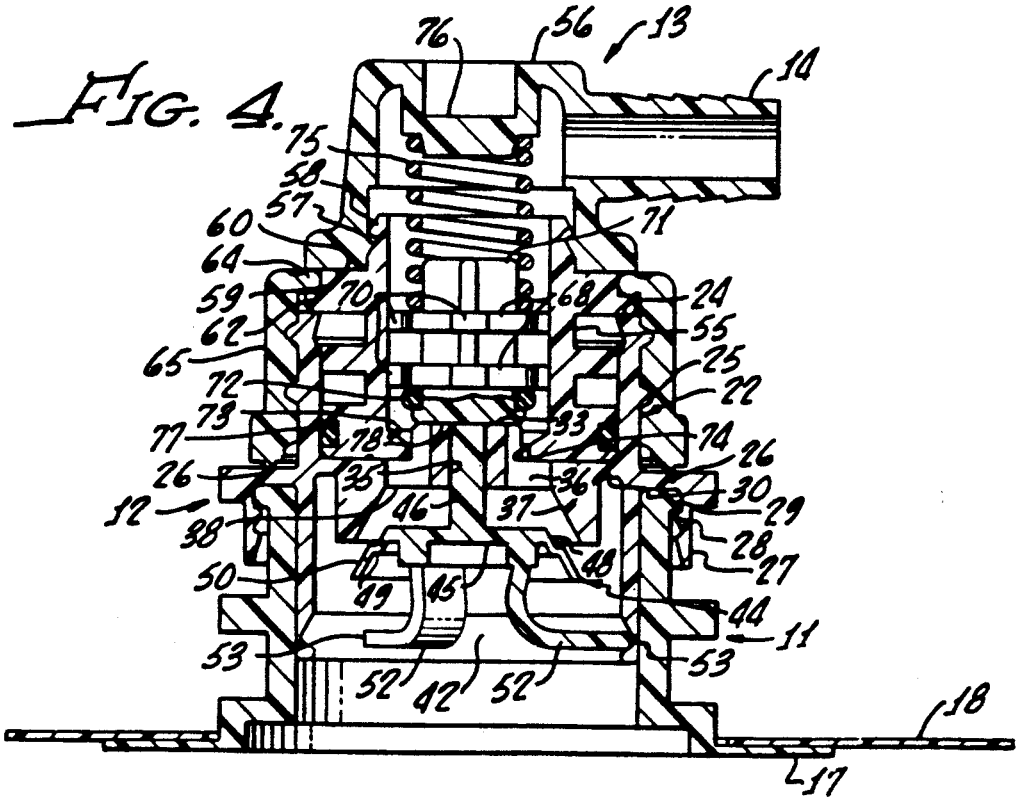
FIG. 4 is a sectional view similar to FIG. 3, but with the valves open.

The nozzle 11, as seen in FIGS. 3 and 4, includes a wide flange 17 at its inner end which is secured to the wall of a bag 18 that is disposed within the box 10. Outwardly of the flange 17, the nozzle 11 is of tubular configuration and includes a flange 19 on its exterior for engagement with filling equipment This construction of the nozzle is conventional.

The control valve 12 includes a tubular plastic body 22 having an inlet end 23 and an outlet end 24. Near the outlet end is an exterior thread 25. The inlet end portion of the valve body 22 is received within the nozzle 11. A transverse flange 26 extends outwardly from the central portion of the valve body over the outer end of the nozzle 11. An annular sleeve section 27 projects from the transverse flange 26 toward the inlet end 23, defining an annular space that receives the outer end portion of the nozzle 11. A lip 28 on the inner surface of the sleeve section 27 of the valve body 22 cooperates with an external shoulder 29 on the nozzle 11 to retain the valve body 22 on the nozzle.

A transverse wall 30 extends across the passageway through the interior of the valve body 22 at a location intermediate the inlet end 23 and the outlet end 24 of the valve body.

The wall 30 is flat on the side facing the outlet end 24 except for a central projecting portion 32 that includes a collar 33 from which extend three equally spaced radial spokes 34 An opening 35 extends through the collar 33. Around the collar 33 are three additional openings 36 which are equally spaced angularly and positioned between adjacent spokes 34.

On the side facing the inlet end 23, the wall 30 defines a frustoconical valve seat 37 that connects at its apical end to a flat transverse surface 38 within the valve seat. The openings 36 through the wall 30 are within the confines of the valve seat 37. The frustoconical valve seat 37 typically will have an angle of 30 degrees relative to the longitudinal axis of the valve body 22.

Adjacent the inlet end 23 a rounded annular groove 42 is formed in the inner surface of the tubular wall of the valve body 22. The surface of the groove 42 inclines toward the inner surface of the tubular valve body wall at a more shallow angle toward the outlet end 24 than it does toward the inlet end 23.

A poppet 44 is received in the valve body 22 to control the flow through the openings 36. The poppet 44 includes a transverse circular disc portion 45, which is of slightly lesser diameter than that of the apical end of the valve seat 37. A central cylindrical post 46 projects outwardly from the disc portion 45 at the longitudinal axis of the poppet. The post 46 fits within the opening 35 in the wall 30 and extends beyond the projection 2.

Projecting away from the disc portion 45 of the poppet on the side opposite from the post 46 is a tapered flange 47. The first part 48 of this flange that connects to the disc portion 45 is tapered at the same angle as that of the valve seat 37, but has a smaller lateral dimension so that it does not engage the valve seat. The flange 47 is of stepped configuration, including an offset 49 that connects to an outer part 50 of greater lateral dimension. When the poppet is advanced toward the wall 30, the outer flange part 50 will complementarily engage the valve seat 37 while the central disc portion 45 remains spaced from the undersurface 38 of the wall 30. The outer flange part 50 is made thin and flexible to enable it to seal against the valve seat even if these surfaces should have minor dimensional variations. The inner flange section 48 connects to the rigid disc portion 45 and inherently is less flexible than the outer flange part 50.

Inwardly of the flange 47, the poppet 44 includes a ring 51 on the side of the disc portion 45 that faces the inlet end 23. Three equally spaced beams 52, rectangular in cross-section and parallel to the longitudinal axis of the poppet 44, project away from the ring 51 (see FIG. 2). As the poppet is molded, the beams 52 are straight and perpendicular to the disc portion 45.

The poppet 44 is proportioned relative to the valve body such that when the outer flange portion 50 engages the valve seat 37, the ends 53 of the beams 52 are spaced outwardly beyond groove 42 at the inlet end 23 of the valve body 22. To complete the installation of the poppet 44, the beams 52 are bent radially outwardly and axially inwardly toward the valve body, causing their outer ends 53 to enter the groove 42 in the wall of the valve body. The groove 42 retains the ends 53 of the beams 52, which then have a bowed configuration such as shown in FIGS. 3 and 4. As a result of this bending of the beams 52 these members act as leaf springs which bias the poppet toward the wall 30, maintaining the outer portion 50 of the poppet flange 47 in engagement with the valve seat 37. This holds the poppet in the closed position so that any fluid entering the inlet end 23 cannot flow past the poppet 44 to the openings 36. A strong biasing force may be generated by the integral leaf springs of the poppet.

The connector valve assembly 13, which is conventional, includes a tubular body 55 which at its outlet end connects to a hollow member 56 that includes the outlet 14. The member 56 snaps into place over the outer end portion of the valve body 55 as a bead 57 on the member 56 moves past an opposing bead 58 on the valve body 55. In addition, to assure a secure attachment, the end surface 59 of the member 56 may be sonically welded to a radial shoulder 60 near the outer end of the valve body 55. The radially outer portion of the surface 59 of the member 56 extends beyond the shoulder 60 of the valve body 55 and cooperates with a radially outwardly projecting flange 62 on the member 55 to define an annular groove. An annular inwardly directed flange 64 of a collar 65 is received and retained within the annular groove. The collar 65 thereby is rotatable relative to the valve body 55, but does not move axially relative to it. The inner wall of the collar 65 is spaced from the outer wall of the valve body 55 and is provided with a thread that can mate with the thread 25 on the valve body 22.

Inside the connector valve body 55 is a plunger 67 which includes two spaced circular disc portions 68.

Four lugs 70 project outwardly beyond the disc portions 68 to engage the inner cylindrical surface of the valve body 55. This guides the plunger 67 within the valve body 55, and provides a passageway through the valve body around the disc portions 68 and intermediate the lugs 70. A cruciform portion 71 extends between the two disc portions 68 and outwardly beyond the upper disc portion 68.

Beneath the lower disc portion 68 is an annular groove which receives an O-ring 72 that is engageable with a tapered valve seat 73 in the valve body 55 adjacent its inner end The end portion of the plunger 67 extends into the opening 74 at the inner end of the valve body 55 adjacent the valve seat 73. A compression spring 75 bears against the outer disc portion 68 of the plunger 67 and the outer wall 76 of the member 56, biasing the plunger to a normal closed position in which the O-ring 72 bears against the valve seat 73. This precludes the flow of liquid through the connector valve assembly The connector valve 13 may be connected to the control valve 12 by threading the collar 65 onto the valve body 22. As this is done, the inlet end of the valve body 55 enters the valve body 22 where it is sealed by means of an O-ring 77 around the periphery of the valve body 55. Continued rotation of the collar 65 will advance the valve body 55 axially into the valve body 22

Ultimately, the end surface 78 of the plunger 67 engages the end of the post 46 and pushes the post downwardly and with it the entire poppet 44 against the bias of the leaf springs 51. This causes the flange 50 of the poppet to disengage the frustoconical valve seat 37. Fluid now can flow past the poppet 44 to the openings 36.

Further advancement of the connector valve body 55 into the valve body 22 causes the end surface 78 of the plunger 67 to engage the outer surface of the projecting part 32 of the wall 30. The valve body 55 at the opening 74 is of larger diameter than the width of the projecting portion 32 at the ends of the spokes 34. Consequently, the valve body 55 will continue to move axially and the movement of the plunger is arrested by the projecting portion 32. This displaces the plunger 67 relative to the valve body 55 so that the O-ring 72 no longer engages the valve seat 73. Therefore, the line connector valve 13 is opened. Fluid then can flow from the bag 17 through the openings 36 and through the valve body 55 into the outlet 14.

Both valves are closed automatically by reverse rotation of the collar 65. As the valve body 55 is moved away from the control valve 21, the spring 75 biases the plunger 67 to the closed position. The poppet 44 is returned to engagement with the valve seat 37 by the leaf springs 52.

The foregoing detailed description is to be clearly understood as given by way of illustration and example only, the spirit and scope of this invention being limited solely by the appended claims.

What is claimed is:

1. A flow control device comprising a valve body having a wall defining an internal passageway having an inlet end and an outlet end, a valve seat in said passageway, and a poppet engageable with said valve seat for controlling flow through said passageway, said poppet being of plastic material and including a plurality of integral resilient elements projecting therefrom toward said inlet end, said valve body having retention abutment means on said wall adjacent said inlet end, said resilient elements being bent radially outwardly away from the longitudinal axis of said passageway so that the outer ends thereof engage said retention abutment means and are retained thereby, said resilient elements being remote from said wall other than at said outer ends thereof, and said resilient elements act as leaf springs which exert a resilient force biasing said poppet toward said valve seat for closing said passageway.

2. A device as recited in claim 1 in which said poppet includes a frustoconical flange engageable with said valve seat, said flange being resilient and deflectable for enhancing the ability of said poppet to preclude flow through said passageway.

3. A device as recited in claim 1 in which said poppet includes a relatively rigid central portion, and said flange includes an inner part connected to said central portion and an outer part extending from said inner part, said outer part being configured such that it is engageable with said valve seat in response to the bias of said resilient elements, said inner part being remote from said valve seat when said outer part engages said valve seat.

4. A device as recited in claim 3 in which said flange is of stepped configuration and includes an offset portion interconnecting said inner part and said outer part of said flange.

5. A device as recited in claim 1 in which said body is made of plastic material.

6. A device as recited in claim 1 in which said resilient elements when in their free positions are substantially parallel to the longitudinal axis of said passageway.

7. A device as recited in claim 1 in which said resilient elements are substantially straight and parallel to each other and to the longitudinal axis of said passageway when in their free positions.

8. A device as recited in claim 1 in which said poppet includes a central transverse portion, and in which said resilient elements are beams which are straight and substantially perpendicular to said central portion in their free positions.

9. A device as recited in claim 8 in which when said poppet engages said valve seat, said beams in their free positions extend outwardly beyond said retention abutment means.

10. A device as recited in claim 8 in which there are three of said beams equally spaced apart.

11. A device a recited in claim 1 in which said retention abutment means includes groove means in the said wall defining said passageway, said beams being bent outwardly away from the longitudinal axis of said passageway with the ends thereof received in said groove means.

12. A device as recited in claim 11 in which said groove means is an annular groove in said wall defining said passageway.

13. A device as recited in claim 1 including a second wall extending across said passageway adjacent said valve seat on the downstream side thereof, said second wall having opening means therethrough for permitting flow through said passageway, said second wall having an additional opening therethrough, said poppet including a post projecting therefrom and extending through said additional opening, said post having an end spaced beyond said second wall for providing a means for opening said poppet by pressing against said post to displace said poppet from said valve seat.

14. A device as recited in claim 13 in which said second wall includes a protuberance extending toward said outlet end, said additional opening extending through said protuberance, said protuberance being adapted to engage the plunger of a connector valve when a connector valve is introduced into said valve body for displacing such a plunger from a closed position to an open position.

15. The method of providing a flow control device comprising the steps of forming a body having a wall defining a passageway which has an inlet end and an outlet end, providing a valve seat in said passageway, constructing an integral plastic poppet engageable with said valve seat for precluding flow through said passageway, said poppet being constructed to include a plurality of elements projecting toward said inlet end, and then bending said projecting elements outwardly away from the center of said passageway and holding the outer ends thereof relative to said body by engaging said outer ends with abutment means on said wall while maintaining the remaining portions of said elements remote from said wall, whereby said bent elements act as leaf springs which provide a resilient force biasing said poppet to a position in which it engages said valve seat.

16. The method of providing a flow control device comprising the steps of forming a plastic body having a wall defining a passageway which has an inlet end and an outlet end, providing an annular tapered valve seat in said passageway, constructing an integral plastic poppet having a central portion and a tapered edge portion, said tapered edge portion being made engageable with said valve seat for precluding flow through said passageway, said poppet being constructed to include a plurality of elements projecting from said central portion toward said inlet end, forming an internal groove in said wall adjacent said inlet end, positioning said poppet in said passageway, and then bending said projecting elements outwardly away from the center of said passageway so that the outer ends thereof enter said groove and engage said wall at said groove such that all other portions of said elements are remote from said wall, whereby said bent elements act as leaf springs which provide a resilient force biasing said poppet to a position in which said tapered edge portion thereof engages said valve seat for thereby precluding flow through said passageway.

17. The method as recited in claim 16 in which for said tapered edge portion a flange is provided so as to project from said central portion, said flange being made deflectable so as to enhance its ability to form a seal with said valve seat.

18. The method as recited in claim 17 in which said flange is formed with an outer part of greater lateral dimension than an inner part of said flange, and only said outer part of said flange is brought into engagement with said valve seat.

19. The method as recited in claim 16 including the steps of forming an integral projection on said poppet extending toward said outlet end, and pressing on said projection to move said poppet away from said valve seat against the force of said bent elements.

20. The method as recited in claim 16 in which said projecting elements are formed as elongated beams which in their free positions are substantially perpendicular to said central portion and parallel to the longitudinal axis of said passageway, the ends of said beams in their free positions when said tapered portion of said poppet engages said valve seat extending axially beyond said groove in said body.

* * * * *